US006597561B1

(12) United States Patent
Devooght et al.

(10) Patent No.: US 6,597,561 B1
(45) Date of Patent: Jul. 22, 2003

(54) ELECTRICAL CONTACT SYSTEM

(75) Inventors: Geert Devooght, Zwevegem (BE); Willy Marrecau, Rome, GA (US)

(73) Assignee: N.V. Bekaert S.A., Zwevegem (BE)

( * ) Notice: Subject to any disclaimer, the term of this patent is extended or adjusted under 35 U.S.C. 154(b) by 0 days.

(21) Appl. No.: 10/018,791

(22) PCT Filed: Jun. 7, 2000

(86) PCT No.: PCT/EP00/05238

§ 371 (c)(1),
(2), (4) Date: Mar. 4, 2002

(87) PCT Pub. No.: WO01/00356

PCT Pub. Date: Jan. 4, 2001

(30) Foreign Application Priority Data

Jun. 23, 1999 (EP) ..... 99202013

(51) Int. Cl.[7] ..... H01G 4/228

(52) U.S. Cl. ..... 361/306.1; 361/321.1; 361/303; 361/301; 361/330

(58) Field of Search ..... 361/306.1, 719, 361/751, 433, 301, 303, 306, 529, 541, 321.1, 322, 328, 330; 55/269; 336/192

(56) References Cited

U.S. PATENT DOCUMENTS

| | | | | |
|---|---|---|---|---|
| 4,144,509 | A | * | 3/1979 | Boutros |
| 4,846,732 | A | * | 7/1989 | Meelhuysen |
| 5,207,807 | A | * | 5/1993 | Manfr' et al. |
| 5,357,399 | A | * | 10/1994 | Salisbury |
| 5,527,569 | A | * | 6/1996 | Hobson et al. |
| 5,557,923 | A | | 9/1996 | Bolt et al. |
| 5,779,885 | A | * | 7/1998 | Hickok et al. |
| 5,873,918 | A | | 2/1999 | Dillman et al. |
| 6,373,366 | B1 | * | 4/2002 | Sato et al. |
| 6,392,523 | B1 | * | 5/2002 | Tsunemi |

FOREIGN PATENT DOCUMENTS

| | | |
|---|---|---|
| EP | 0 358 522 | 3/1990 |

* cited by examiner

*Primary Examiner*—Dean A. Reichard
*Assistant Examiner*—Nguyen Ha
(74) *Attorney, Agent, or Firm*—Foley & Lardner

(57) ABSTRACT

An electrical contact system is provided which comprises an electrically conductive porous fleece and one or more contact bodies. The electrically conductive porous fleece and the contact bodies are sintered to each other, so avoiding hot spots during the use of the element.

21 Claims, 3 Drawing Sheets

ELECTRICAL CONTACT SYSTEM

FIELD OF THE INVENTION

The present invention relates to electrical contact system and an electrically conductive filter element comprising such electrical contact system.

BACKGROUND OF THE INVENTION

Electrically conductive filter elements are known, e.g. from EP0764455. A filter element, comprising metal fibers, is used to filter soot particles. To regenerate the filter element, an electric current is applied. The filter is heated by the Joule effect.

At present, the electric current is supplied to the filter fleece via electrical contact bodies, which are welded to the fleece, or which may be clamped to the fleece.

In spite of all care, the contact surface between contact body and fleece has some disadvantages. Due to the high current during welding, the fleece may be damaged e.g. burned locally. When current passes from contact body to the fleece, the current tends to follow preferential routes. The current flows preferentially from contact body into the fleece at the places, where, due to uneven welding, the contact between contact body and fleece is most intimate, compared to the rest of the contact surface between contact body and fleece. The same happens when contact body and fleece are clamped to each other.

These preferential routes cause so called "hot spots" on the fleece surface. These spots tend to heat up more than the rest of the fleece surface, since more current flows locally, and the temperature is increased locally extensively due to the Joule effect. At these hot spots, the fiber fleece will oxidize more, causing quick degeneration of the fleece locally. This finally results in a burning through of the transition zone between the fleece and the contact body.

This problem occurs not only for electrically regenerating filters, but also occur in all cases where a contact body (having a low electrical resistance) is to contact an electrically conductive porous fleece (having a high electrical resistance).

SUMMARY OF THE INVENTION

The invention has the objective to provide an electrical contact system, which comprises a contact body and a electrically conductive porous fleece, which does not have these disadvantages. According to the present invention, the electrically conductive porous fleece and the contact body are sintered to each other.

It was found than, when the contact body and the electrically conductive porous fleece are sintered to each other, no hot spots were noticed during the supply of electric current to the electrically conductive porous fleece via the contact body. Due to the very intimate and equal contact over the total contact surface between contact body and electrically conductive porous fleece, the electric current which has to flow from contact body to the electrically conductive porous fleece will meet the same resistance on every spot of the contact surface between contact body and electrically conductive porous fleece.

The electric current, provided to a first contact body by an electrical circuit, will flow from this contact body, via a contact surface into the electrically conductive porous fleece. The electric current further flows through the electrically conductive porous fleece towards a second contact body, also making contact to the electrically conductive porous fleece via a contact surface. It is clear that, in the scope of the invention, the electric current flowing through the electrically conductive porous fleece effects the heating of the filter element.

In an electrical contact system as subject of the invention, the electric current does not flow from contact body into the electrically conductive porous fleece via preferential routes. The change from low electrical resistance (contact body) to higher electric resistance (electrically conductive porous fleece) will be very smooth and an equal current distribution over the total volume of the electrically conductive porous fleece is provided. Due to the sintering action, very intensive contact is obtained between fibers of the electrically conductive porous fleece and the contact body. They are so to say micro-welded to each other.

With electrically conductive porous fleece is meant a preferably sheet-like volume of electrically conductive fibers and/or particles. Preferably, metal fibers or metal particles are used. Most preferably, steel fibers with a high specific electrical resistance are used. Examples of fibers are stainless steel fibers from AISI 300- or AISI 400-serie alloys such as AISI 316L or AISI347, or alloys comprising Fe, Al and Cr, such as Fecralloy®. Preferably stainless steel comprising chromium, aluminum and/or nickel and 0.05 to 0.3% by weight of yttrium, cerium, lanthanum, hafnium or titanium are used.

Fiber diameter preferably is between 1 and 100 $\mu$m, e.g. between 4 and 25 $\mu$m. The electrically conductive porous fleece is connected to one or more contact bodies by a sintering action. So the electrically conductive porous fleece will become a sintered fleece. However, an electrically conductive porous fleece may be already sintered before it is subjected to a sintering action to connect it to one or more contact bodies.

The metal fibers may be obtainable by bundle drawing or by shaving techniques (e.g. as described in U.S. Pat. No. 4,930,199), or by any other process as known in the art.

With contact body is meant an object which is connected to an electric circuit, e.g. via a lead wire, and which is connected to the electrically conductive porous fleece via a contact surface in order to provide the electric current from the electric circuit to this electrically conductive porous fleece.

According to the invention, a contact body may e.g. be a metal volume, an expanded or perforated metal plate, a woven metal wire net, a woven or knitted metal fiber fabric or a metal foil, or even metal fiber yarn which extends in a flare. The contact body contacts the electrically conductive porous fleece over a limited surface.

According to the invention, one or more contact bodies are sintered to an electrically conductive porous fleece. The position of these contact bodies on the electrically conductive porous fleece may be changed depending on the requirements as specified by the use of the electrical contact system. Usually, two or more contact bodies are sintered at the border of the electrically conductive porous fleece. Most usually, the contact bodies are so sintered to the electrically conductive porous fleece that the largest distance between the contact bodies is provided.

In case the contact bodies are metal foils, metal mesh, wires metal yarns or woven, braided or knitter metal fabrics, the contact bodies usually extend the border of the electrically conductive porous fleece to which they are sintered. Most usually, they are sintered to one side of the electrically conductive porous fleece, or they are located between two layers of the electrically conductive porous fleece. To obtain this, a first layer of electrically conductive porous fleece is provided. The contact bodies then are positioned on the surface of this first layer of electrically conductive porous fleece. They are positioned in such a way that they partially extend a border of the electrically conductive porous fleece. A second layer of electrically conductive porous fleece is put on the first layer and the contact bodies. These elements are then sintered together in appropriate circumstances. An electrical contact system is so obtained, comprising a electrically conductive porous fleece, out of which contact bodies extend.

Alternatively contact bodies are clamped to the border of the electrically conductive porous fleece, before they are subjected to a sintering action.

In case metal yarn, comprising metal fibers or filaments, is used to provide contact bodies, the fibers or filaments which extend from the yarn at the end of the yarn which is to be sintered to the electrically conductive porous fleece, are unraveled to some extend, providing a flare. This flare, or so to say brush-like structure, is then sintered to the electrically conductive porous fleece, so increasing the contact surface between contact body and electrically conductive porous fleece.

Preferably, the contact body and the electrically conductive porous fleece, comprising metal fibers, are provided by the same metal alloy.

Such electrical contact system as subject of the invention may be used to provide a heating element or a heatable or regeneratable filter, e.g. an exhaust particulate filter, such as a diesel exhaust filter. According to the functionality, required by the application, the electrically conductive porous fleece may have a different porosity, thickness, composition, electrical resistance, dimension or shape. Also according to the application, the position of the contact bodies compared to the electrically conductive porous fleece may be chosen.

BRIEF DESCRIPTION OF THE DRAWINGS

The invention will now be described into more detail with reference to the accompanying drawings wherein.

DESCRIPTION OF THE PREFERRED EMBODIMENTS OF THE INVENTION

Figure 1:
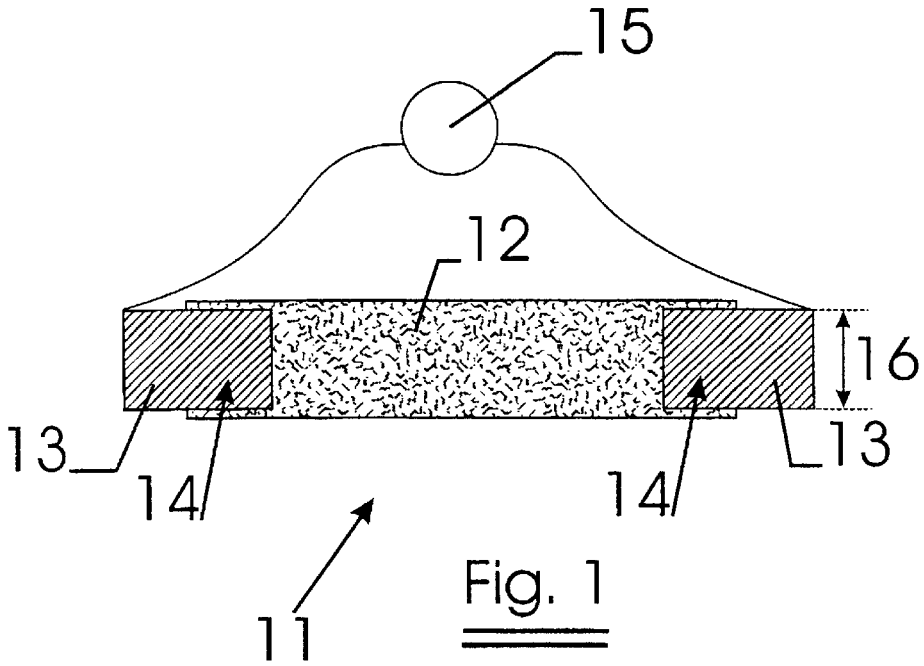
FIG. 1 shows an electrical contact system as subject of the invention.

FIG. 1 hows an embodiment of an electrical contact system 11 as subject of the invention. A electrically conductive porous fleece 12 is sintered to two contact bodies 13, each at one edge of the electrically conductive porous fleece 12. Both contact bodies contact the electrically conductive porous fleece over a surface 14. An electrical circuit 15 is connected to both contact bodies 13. The current runs from the electric circuit 15 via one of the contact bodies 13, through the surface 14, via the fibers or powder in the electrically conductive porous fleece 12, again via the second surface 14 and contact body 13 to the opposite end of the electric circuit.

A preferred embodiment is an electrically conductive porous fleece out of Fecralloy® bundle drawn fibers with fiber diameter of 17 $\mu$m The electrically conductive porous fleece has a surface weight of approximately 1000 g/m$^2$. To the electrically conductive porous fleece, two contact bodies, being Fecralloy® foil of a thickness of 80 $\mu$m are sintered. Both contact bodies are located at the same side of the electrically conductive porous fleece.

The width 16 of the electrically conductive porous fleece is 33 mm, preferably both for electrically conductive porous fleece and for contact body. The contact surfaces 14 are preferably square. Similar embodiments are obtainable using other dimensions.

Alternative embodiments are provided using other fiber diameters, such as 12 $\mu$m, 22 $\mu$m or 35 $\mu$m, or a combination from different diameters, being bundle drawn or shaved Fercalloy® fibers.

Figure 2:
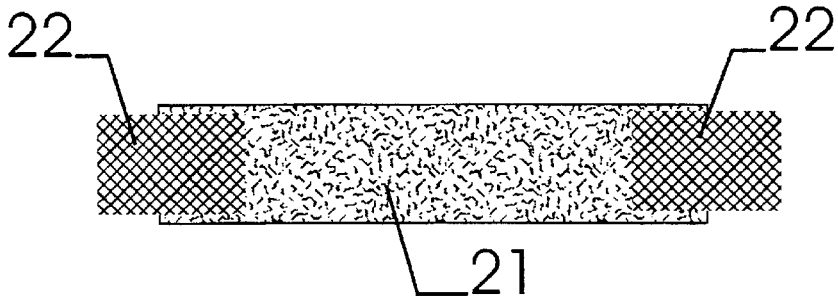
FIGS. 2 to 5 show contact bodies, sintered to an electrically conductive porous fleece as subject of the invention.

Alternative embodiments are shown in FIGS. 2 to 8. FIG. 2 shows an electrically conductive porous fleece 21 on which two metal meshes 22 are sintered, each on a side of the electrically conductive porous fleece.

Figure 3:
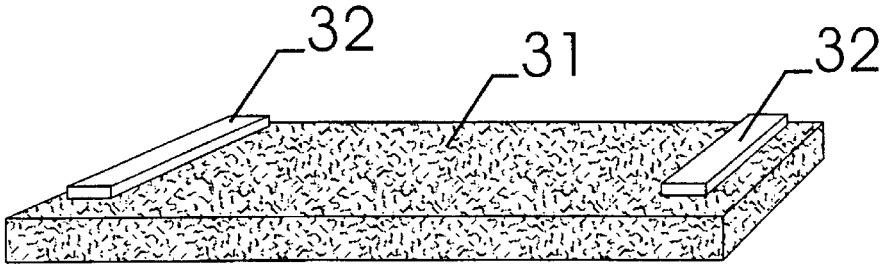
Figure 4:
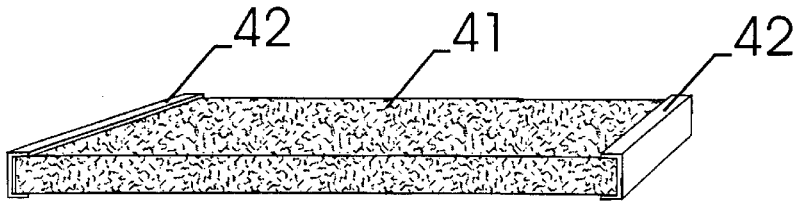
Figure 5:
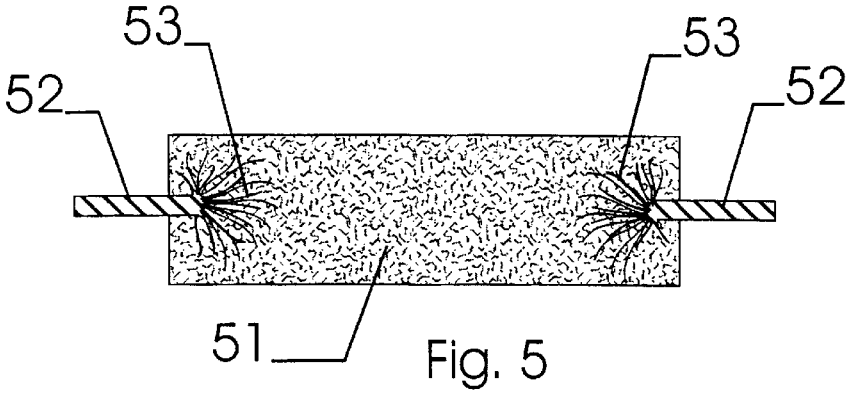

FIG. 3 shows an electrically conductive porous fleece 31, on which 2 contact bodies 32, being two metal volumes, are sintered. FIG. 4 shows two so-called end caps 42, which are sintered to an electrically conductive porous fleece 41, and which serve as contact bodies. FIG. 5 shows a electrically conductive porous fleece 51 to which two contact bodies, being a metal fiber yarn 52, having a flare 53 at the contact surface of contact body are sintered.

It is clear that, if the application requires only one or more than 2 contact bodies may be applied to the fleece.

Figure 6A:
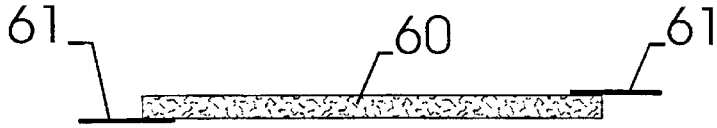
FIGS. 6A to 6E show contact bodies, sintered to different sides of the electrically conductive porous fleece.
Figure 6B:
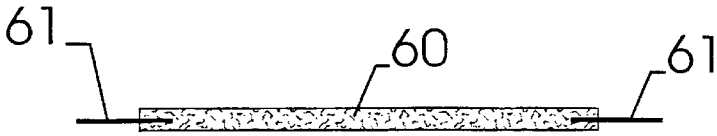
Figure 6C:
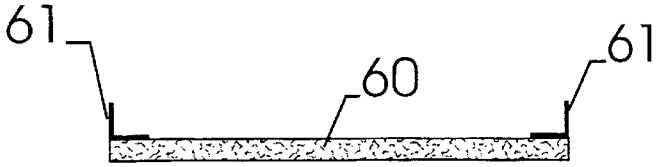
Figure 6D:
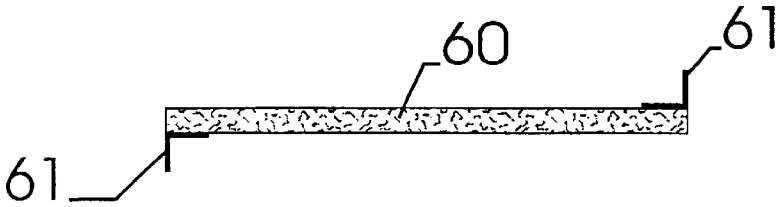

It is not necessary that all contact bodies have to be sintered at one side of the electrically conductive porous fleece. As can be seen in other alternative embodiments of electrical contact system, the contact bodies 61 may be sintered on opposite sides of the electrically, conductive porous fleece 60 (FIG. 6*a*), may be sintered between two layers of electrically conductive porous fleece 60 (FIG. 6*b*). Foils, yarns, plates or meshes do not have to be parallel to the electrically conductive porous fleece (FIGS. 6*c* and 6*d*).

Figure 6E:
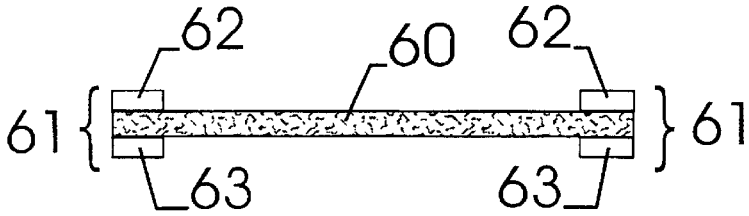

As shown in FIG. 6*e*, two foils, meshes, plates or alike (62 and 63) may be sintered on opposite sides of the electrically conductive porous fleece 60, so providing one contact body 61 to the electrically conductive porous fleece. Electric current may be supplied to the electrically conductive porous fleece via both parts 62 and 63 of one contact body 61.

Figure 7:
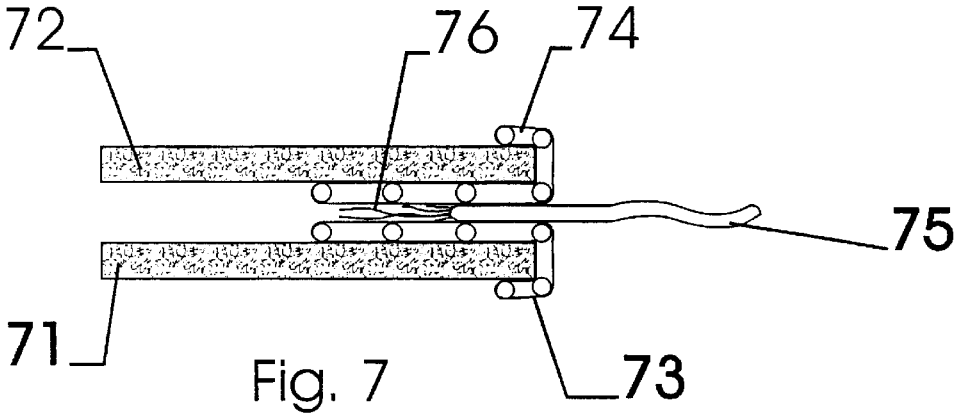
FIG. 7 is another embodiment of a contact body, sintered to an electrically conductive porous fleece as subject of the invention.

Further, an other embodiment of the present invention comprise the elements as shown in FIG. 7:

A electrically conductive porous fleece having two layers 71 and 72,

A contact body comprising two metal fiber meshes 73 and 74 and a conductor 75, being a metal fiber yarn, ending with a flare 76.

The flare 76 lies between the two meshes 73 and 74. The meshes, which stick out from the layered structure of the electrically conductive porous fleece, are bent over 180° on top and on the bottom. All elements are sintered together.

Figure 8:
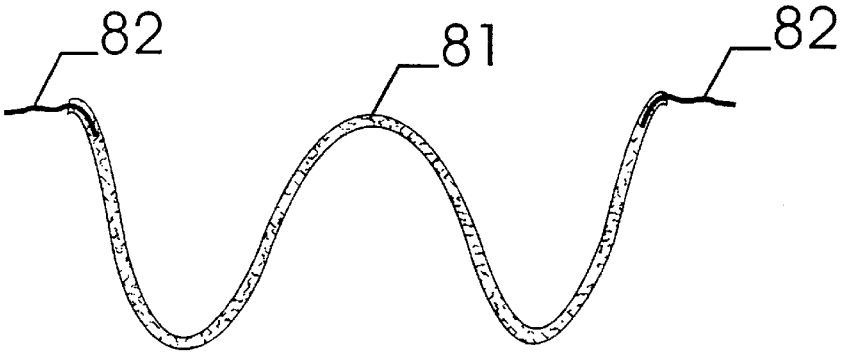
FIG. 8 shows an undulated electrically conductive porous fleece with contact bodies sintered to it.

According to the use of the electrical contact system, the electrically conductive porous fleece 81 of the element may be bend as shown in FIG. 8. Also here, the contact bodies 82 are sintered to the electrically conductive porous fleece, e.g. sintered between different layers of the electrically conductive porous fleece.

The embodiment of a electrical contact system as shown in FIG. 8 is preferably used as an electrically conductive filter element, e.g. an electrically regeneratable filter, to filtering diesel exhaust gasses. Gas to be filtered is to flow through the electrically conductive porous fleece. Soot, being trapped by the filter accumulates on the electrically conductive porous fleece surface and/or in the electrically conductive porous fleece. The filter is regenerated by providing electric current from an electric circuit, which is connected to the contact bodies 82, via these contact bodies 82 to the electrically conductive porous fleece 81.

What is claimed is:

1. An electrically conductive filter element, comprising a contact system, said contact system comprising an electrically conductive porous fleece and one or more contact bodies, said electrically conductive porous fleece comprising metal fibers, wherein said electrically conductive porous fleece and said one or more contact bodies are sintered to each other.

2. An electrically conductive filter element as in claim 1, at least one of said contact bodies is located at the border of said electrically conductive porous fleece.

3. An electrically conductive filter element as in claim 2, at least one of said contact bodies extends partially the border of said electrically conductive porous fleece.

4. An electrically conductive filter element as in claim 1, said electrically conductive porous fleece further comprises metal particles.

5. An electrically conductive filter element as in claim 1, said metal is stainless steel.

6. An electrically conductive filter element as in claim 5, said stainless steel comprising chromium, aluminum and/or nickel and 0.05 to 0.3% by weight of yttrium, cerium, lanthanum, hafnium or titanium.

7. An electrically conductive filter element as in claim 1, said conductive bodies and electrically conductive porous fleece are provided using the same metal alloy.

8. An electrically conductive filter element as in claim 1, said conductive bodies comprise a metal foil.

9. An electrically conductive filter element as in claim 1, said conductive bodies comprise a metal mesh.

10. An electrically conductive filter element as in claim 1, said conductive bodies comprise a woven, braided or knitted structure.

11. An electrically conductive filter element as in claim 1, said conductive bodies comprise metal filaments.

12. An electrically conductive filter element as in claim 11, said contact bodies comprise a metal yarn, said yarn comprises said metal filaments.

13. An electrically conductive filter element as in claim 12, said yarn has a flare, sintered to said electrically conductive porous fleece.

14. An electrically conductive filter element as in claim 1, said contact bodies are sintered between two layers of electrically conductive porous fleece.

15. An electrically conductive filter element as in claim 1, said contact bodies are sintered upon said electrically conductive porous fleece.

16. Use of an electrically conductive filter element as in claim 1 as an electrically heatable filter element.

17. Use of an electrically conductive filter element as in claim 1 as an electrically regeneratable filter element.

18. Use of an electrically conductive filter element as in claim 16, said filter element being an exhaust particulate filter element.

19. Use of an electrically conductive filter element as in claim 16, said filter element being a diesel exhaust filter element.

20. Use of an electrically conductive filter element as in claim 17, said filter element being an exhaust particulate filter element.

21. Use of an electrically conductive filter element as in claim 17, said filter element being a diesel exhaust filter element.

* * * * *